US005598652A

United States Patent [19]

Nurre

[11] Patent Number: 5,598,652

[45] Date of Patent: Feb. 4, 1997

[54] LAMP WITH CHANGEABLE DISPLAY BASE

[76] Inventor: David F. Nurre, 5810 Oakwood, #3H, Lisle, Ill. 60532

[21] Appl. No.: 651,659

[22] Filed: May 21, 1996

Related U.S. Application Data

[63] Continuation of Ser. No. 306,769, Sep. 14, 1994, abandoned.

[51] Int. Cl.[6] ..... G09F 13/00

[52] U.S. Cl. ..... 40/553; 40/660; 362/412

[58] Field of Search ..... 40/554, 553, 660, 40/661, 306, 559; 362/412

[56] References Cited

U.S. PATENT DOCUMENTS

| | | | |
|---|---|---|---|
| 272,567 | 8/1883 | Marsh . | |
| 1,531,577 | 3/1925 | Ruttenberg . | |
| 1,863,607 | 6/1932 | Sabath . | |
| 1,944,040 | 1/1934 | Tam . | |
| 2,177,204 | 10/1939 | Buzick . | |
| 2,577,982 | 12/1951 | Traum . | |
| 2,594,074 | 4/1952 | Rosenfeld . | |
| 3,990,166 | 11/1976 | Nagelkirk | 40/152.2 X |
| 4,019,269 | 4/1977 | Vix | 40/660 |
| 4,028,848 | 6/1977 | Murray . | |
| 4,117,533 | 9/1978 | Hagelthorn | 40/553 X |
| 4,163,998 | 8/1979 | Anderson, et al. . | |
| 4,505,059 | 3/1985 | Morris | 40/661 |

FOREIGN PATENT DOCUMENTS

| | | | |
|---|---|---|---|
| 2482257 | 11/1981 | France | 362/412 |

*Primary Examiner*—Brian K. Green
*Attorney, Agent, or Firm*—Charles F. Meroni, Jr.

[57] ABSTRACT

A lamp base comprising an external transparent sleeve and an interior, outwardly tensioning rigid or semi-rigid thin flexible sleeve or sheet which bears upon the interior of the external transparent sleeve due to outward tension. The rigid or semi-rigid thin flexible sleeve or sheet is capable of securing decorative materials such as wall paper or upholstery or items of specialized sentimental value such as photos or any other pliable flat materials of special interest to the owner. The decorative materials may be easily and repeatedly changed as desired by the owner of the lamp.

19 Claims, 3 Drawing Sheets

LAMP WITH CHANGEABLE DISPLAY BASE

This application is a continuation of application Ser. No. 08/206,769, filed on Sep. 14, 1994, now abandoned.

BACKGROUND

The instant invention relates to the area of lamps, and more particularly, to lamp bases having a transparent tubular base for holding decorative fabrics or articles, such a photos, memorabilia, etc., which may be easily changed by the owner as desired. The fabric or memorabilia or other items are held in place against the interior surface of the transparent base by providing a simple outwardly tensioned interior sheet or sleeve which can press the decorative material or items into place.

Although there have been numerous designs for lamps which have a wide variety of different types of bases, no lamp to date has shown such flexibility in the display and presentation of materials which are of special interest to the user. Two issued U.S. Patents, U.S. Pat. No. 4,163,998 issued to Anderson, et al., and U.S. Pat. No. 2,177,204 issued to Buzick, et al., disclose lamp shades which are capable of displaying photos which are illuminated by the lamp, but neither of these patents has the same flexibility of the present invention in holding a wide variety of decorative articles, such as upholstery fabrics or wallpaper, in the interior of the base of the lamp.

Other patents found in the prior art disclose designs embodying various functional articles in lamp bases such a fish tanks, U.S. Pat. No. 1,944,040 issued to Tam, or terrariums, U.S. Pat. No. 4,028,848 issued to Murray. Only one issued patent appears to change the decoration of a lamp base and this is disclosed in U.S. Pat. No. 1,863,607 issued to Sabath. However, this disclosure required an extensive bracket system to secure a transparent photo or slide which is illuminated by a second light bulb located in the lamp base. It does not use a simple inner sleeve in order to secure and display the decorative articles. Moreover, it is incorporated in a standard ceramic base lamp, and the picture displayed is not behind a simple transparent tube which serves as the main portion of the lamp base itself.

In particular, the present invention allows the lamp user to change coordinating decorative fabric or wallpaper each time upholstery or wall paper are changed so that the lamp may be updated along with changes in home fashions. Until now, the consuming public had to change lamps each time they updated the decor of a room since it was very difficult, if not impossible, to select a furnishing that continued to be in style for a long period of time. As a result, most people would have living rooms or other areas of their home which would look dated after a period of time inasmuch as the decorating budget of the average homeowner or renter simply could not keep up with changing fashions.

SUMMARY OF THE INVENTION

The present invention solves the problems of the prior art by providing a lamp base with a clear tubular base or exterior transparent sleeve and an inner thin flexible sheet forming an outwardly tensioning sleeve upon which a large variety of decorative materials or items may be placed. Fabrics and wallpaper may be used as decorative materials to provide complete room coordination. Prints or photographs may be preserved, protected and displayed to add a special, personalized touch to the decor of a room. Alternatively, special art work may also be purchased and inserted within the lamp base or housing. The lamp base then may be repeatedly and easily disassembled and reassembled in order to change the appearance of the lamp base to suit the changing decorative preferences of the user. Although a table lamp would be one preferred embodiment of the present invention, the present invention could be easily adapted if a floor lamp would be desired. An especially attractive method of displaying photos would be to add a photo mat insert between the transparent exterior sleeve and the interior sleeve wherein the photo mat has a plurality of apertures of different shapes and sizes such as round, oval, rectangular, or square, for the purpose of providing decorative edging for the photos.

Another adaptation of the present invention would be to eliminate the electric bulb and related components so that the result would be a stand alone tubular photo album. Likewise, a further adaption would be to replace the electric bulb and related components with an oil lamp, or other non-electric illumination device.

Thus, it is an object of the present invention to provide a lamp base having a clear tubular housing and an outwardly tensioning sleeve inside the tubular housing upon which fabric or images or other decorative items may be secured and changed at will by the owner or user thereof.

It is yet another object of the present invention to provide a lamp with a changeable decorative base which will allow the owner to match upholstery or wallpaper, and to change said decorative lamp base easily as fashions change.

It is yet another object of the present invention to provide a lamp with a changeable decorative base which can hold decorative articles such as wallpaper, painted sheets or fabrics, or even upholstery material to match the owner's decor thus providing a highly customizable decorative article of furnishing.

These and other objects and advantages of the present invention can be readily derived from the following detailed description of the drawings taken in conjunction with the accompanying drawings present herein and should be considered as within the overall scope of the invention.

DETAILED DESCRIPTION OF THE PREFERRED EMBODIMENT

Figure 1:
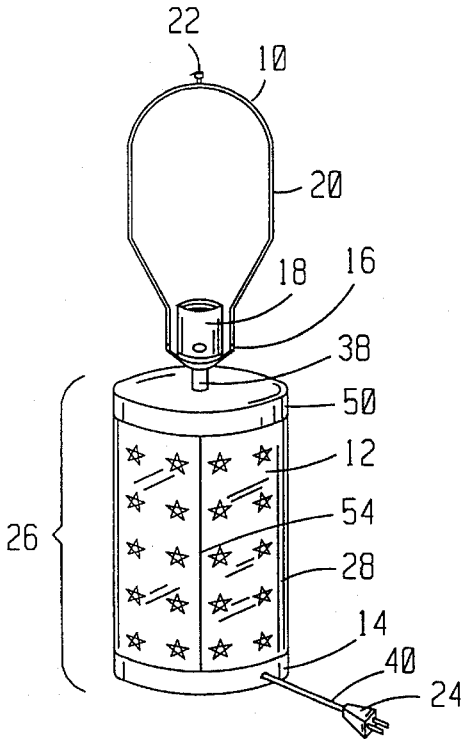
FIG. 1 is a perspective view of an embodiment of the present invention.

FIG. 1 shows a perspective view of table lamp 10 which is one embodiment of the present invention. In this view, a standard lamp configuration is shown with a lamp base assembly 26 comprising a cap 50, foot 14, and plug 24. The present invention further consists of decorative material or article 12 showing through exterior transparent sleeve 28. A seam 54 is created where the edges of decorative material 12 are folded under and into lamp base assembly 26. The cap 50 and foot 14 may be made of any materials, such as painted black metal, for a hi-tech look, or warm woods, or even bright metallics for a modern look. Of course, the ability to change cap 50 and foot 14 as fashions change would also add to the flexibility of the lamp design.

The remaining portions of the table lamp 10 are conventional in nature and consist of light socket 18 used to hold the light bulb, harp socket 16 which holds harp 20; wherein harp 20 holds the lamp shade (not shown) above the lamp base assembly 26, and finial 22 which is used to secure the lamp shade.

Figure 2:
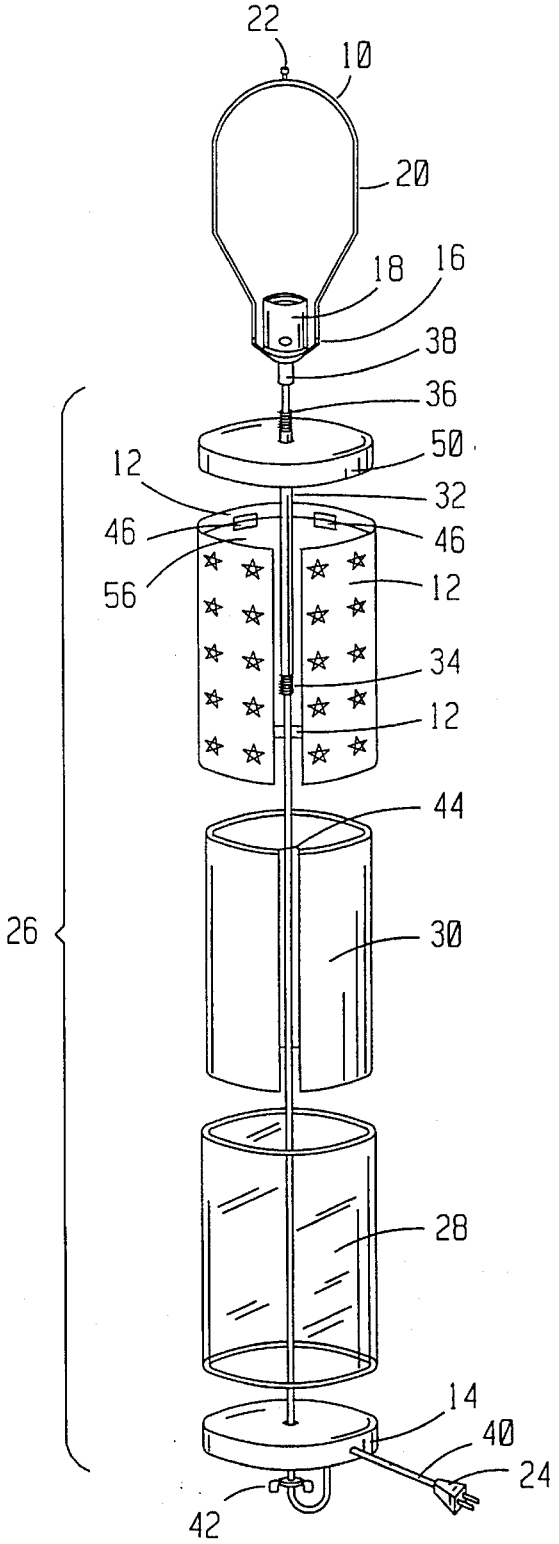
FIG. 2 is a perspective exploded view of an embodiment of the present invention.

FIG. 2 shows an exploded view of table lamp 10. In this view it is easy to ascertain the simplicity with which the decorative material 12 may be changed by the owner. Shown herein, a decorative portion is sandwiched in between a cap 50 and a foot 14. These items are secured together with a lamp pipe 32 which retains lamp electric cord 40 in its center. The lamp pipe 32 is held in place at its upper end with a series of threads, top threads 36, which are threaded into the interior of socket end 38 and extend through an aperture in the cap 50. In the lower end of table lamp 10, the bottom threads 34 of lamp pipe 32 engage with wing nut 42 to secure lamp base assembly 26 together.

The present invention is incorporated into lamp base assembly 26 by providing an interior sleeve 30 which retains backing material 56 and decorative material 12 in place within exterior transparent sleeve 28. Preferably, interior sleeve 30 is slightly outwardly tensile so that it secures backing material 56 and decorative material 12 firmly and evenly against the interior surface of exterior transparent sleeve 28.

Interior sleeve 30 is preferably composed of a flexible, semi-rigid material such as polyethylene or polyvinyl, or other polymeric materials, or a resin impregnated paper or metal. The interior sleeve 30 may be decorative in and of itself, which is especially desirable if photos or smaller pictures are mounted thereupon. Interior sleeve 30 includes a longitudinal gap 44 between its free side edges, with a first side edge being in a spaced apart relationship from a second side edge, as shown in the drawings. Gap 44 allows interior sleeve 30, in conjunction with backing material 56 and decorative material 12, to be radially compressed such that interior sleeve 30, backing material 56, and decorative material 12 may be readily withdrawn from or inserted into exterior transparent sleeve 28. Further, gap 44 allows interior sleeve 30 to expand or contract sufficiently to allow for varying thicknesses of decorative material 12 and/or varying thicknesses of backing material 56 to be retained between interior sleeve 30 and exterior transparent sleeve 28. In other words, the first and second side edges are movable relative to one another.

Preferably, interior sleeve 30 is a flexible, pre-formed sheet which is adapted to fit exterior transparent sleeve 28. Alternatively, interior sleeve 30 may be a flat, flexible sheet or a flat, flexible sheet which is provided with a plurality of closely spaced scores or flutes along its longitudinal axis. These longitudinal scores or flutes function as hinges and allow interior sleeve 30 to bend radially, traversing a latitudinal plane while maintaining stiffness along its longitudinal axis thus allowing interior sleeve 30 to conform to the shape of exterior transparent sleeve 28 while providing sufficient outward tension to allow both backing material 56 and decorative material 12 to bear against the interior surface of exterior transparent sleeve 28.

It should be noted that there are other modes by which backing material 56 and decorative material 12 may be retained within exterior transparent sleeve 28 and these should all be considered within the overall scope of the present invention.

Backing material 56 may be composed from a variety of materials such as construction weight paper or other fibrous materials, or plastics and other polymeric materials. Backing material 56 may be used to lend stiffness to light weight or pliable decorative materials such a tissue paper or fabric which might tend to collapse or wrinkle during insertion into lamp base assembly 26. Such light weight or pliable decorative materials may be attached to backing material 56 with standard adhesive tape 46 or contact cement or other common materials which are readily available in the marketplace. Typically, decorative material 12 is cut to size slightly larger than backing material 56 so that the edges of decorative material 12 may be folded back over the edges of backing material 56 in order to produce a clean finished edge. Additionally, backing material 56 may function as a mat board behind decorative material 12 in cases where undersize decorative materials are not in and of themselves sufficiently large to fill the entire interior surface of exterior transparent sleeve 28. Such undersize materials would include pressed flowers, baseball cards, photographs, etc. Such undersize decorative materials may be attached to backing material with double face adhesive tape or contact cement or other common materials, readily available in the marketplace.

It should be noted that backing material 56 is not entirely essential to the current invention. Decorative materials such as wallpaper, wrapping paper or printed art work, as well as other decorative materials sufficiently rigid to be self supporting as well as sufficiently large to fill the entire interior surface of exterior transparent sleeve 28 may be retained between interior sleeve 30 and exterior transparent sleeve 28 without the inclusion of backing material 56.

Exterior transparent sleeve 28 is preferably made from glass, plexiglass, or acrylic, but a number of other inexpensive polymers, such as polyethylene, may be substituted therefore. Exterior transparent sleeve 28 may be either crystal clear, or it may be tinted for special effects, coated with UV filters to prevent sun damage of the contents, or pearlized for a more dramatic effect. Of course, separate inserts may be provided to accomplish these same effects. Although in the set of drawings provided herein the exterior transparent sleeve 28 is shown as cylindrical in configuration, a number of different configurations may also be used, including oval or elliptical, or even square or rectangular. The exterior transparent sleeve 28 has a top end and a bottom end. As best shown in FIGS. 1 and 2, the light socket is disposed adjacent to the top end of the sleeve 28, with cap 50 in confronting engagement with the top end and foot 14 in confronting engagement with the bottom end of sleeve 28.

It should also be noted that cap 50 and foot 14 are not altogether essential to the configuration of the present invention and either may be adapted or totally eliminated. In the case of cap 50, this element may be eliminated from the design by simply closing the top end of exterior transparent sleeve 28 such that it acquires the form of an inverted water glass. An annular lip then could be provided at the bottom of the lamp base, which would hold decorative materials 12, backing material 56 and interior sleeve 30 in place. Similarly, other designs may be substituted such as providing threaded caps 50 and foots 14 which can be screwed into a glass, acrylic or plastic exterior transparent sleeve 28. Such modifications also should be considered as within the overall scope of this invention.

Figure 3:
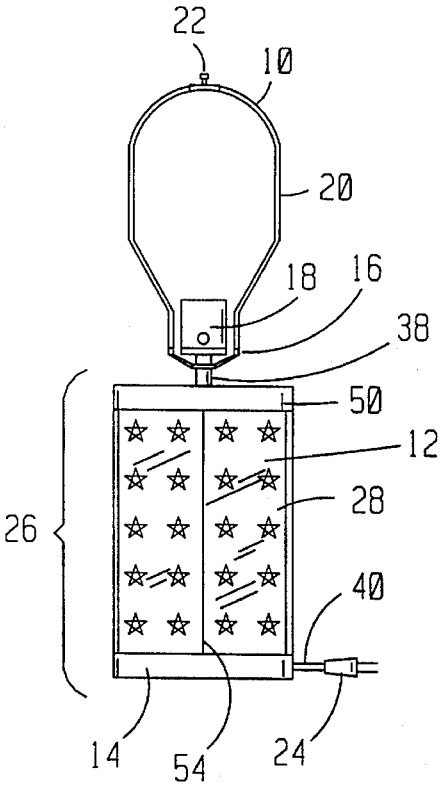
FIG. 3 is a front view elevation of an embodiment of the present invention.

FIG. 3 shows the present invention in an elevated front view. Decorative material 12 is clearly visible through external transparent sleeve 28.

Figure 4:
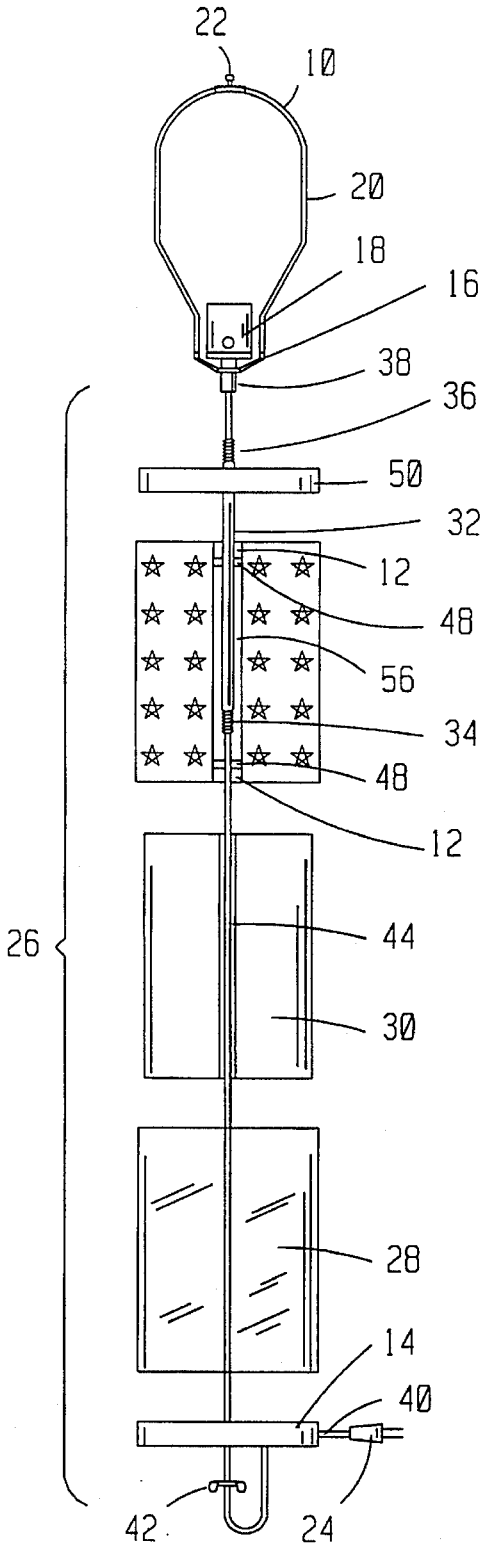
FIG. 4 is an exploded elevational view of an embodiment of the present invention.

FIG. 4 shows yet another exploded front view of the present invention. In this figure, cap 50 abuts both interior sleeve 30 and exterior transparent sleeve 28, and both abut foot 14. Again, gap 44 is clearly visible in this view and it is shown expanded inasmuch as interior sleeve 30 has been removed from exterior transparent sleeve 28. In order to change or update decorative materials 12, the owner need only remove wingnut 42 so that exterior transparent sleeve 28, interior sleeve 30, backing material 56, and decorative material 12 will readily fall away from cap 50 so that table lamp 10 may be easily disassembled to update the decor of table lamp 10.

A small seam 54 (shown in FIG. 3) is created where the free edges of decorative material 12 are wrapped around backing material 56 and the edges of interior sleeve 30 meet. In this particular view, double sided tape 48 has been used to attach the edge of decorative material 12 to the backside of backing material 56. A portion of the double sided tape 48 is shown exposed to illustrate the use of such an item.

Figure 5:
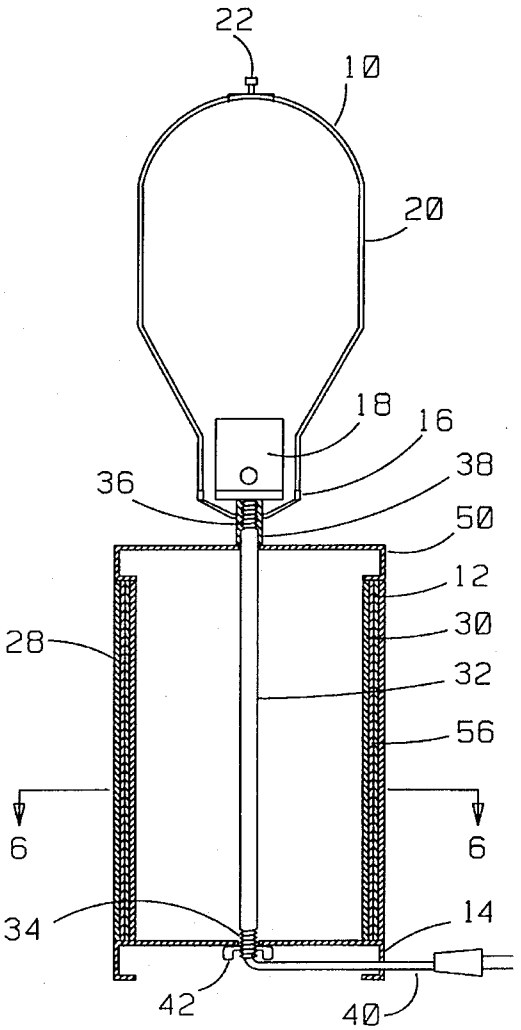
FIG. 5 is a partial longitudinal cross section of an embodiment of the present invention, showing a cross section of the lamp base only.

FIG. 5 shows table lamp 10 in partial longitudinal cross section through its midpoint. In this view is clearly shown the manner in which lamp pipe 32 is secured into both socket end 38 and wingnut 42. The thin layer of decorative material 12, together with backing material 56, is clearly sandwiched there between and abuts both interior sleeve 30 and exterior transparent sleeve 28.

Figure 6:
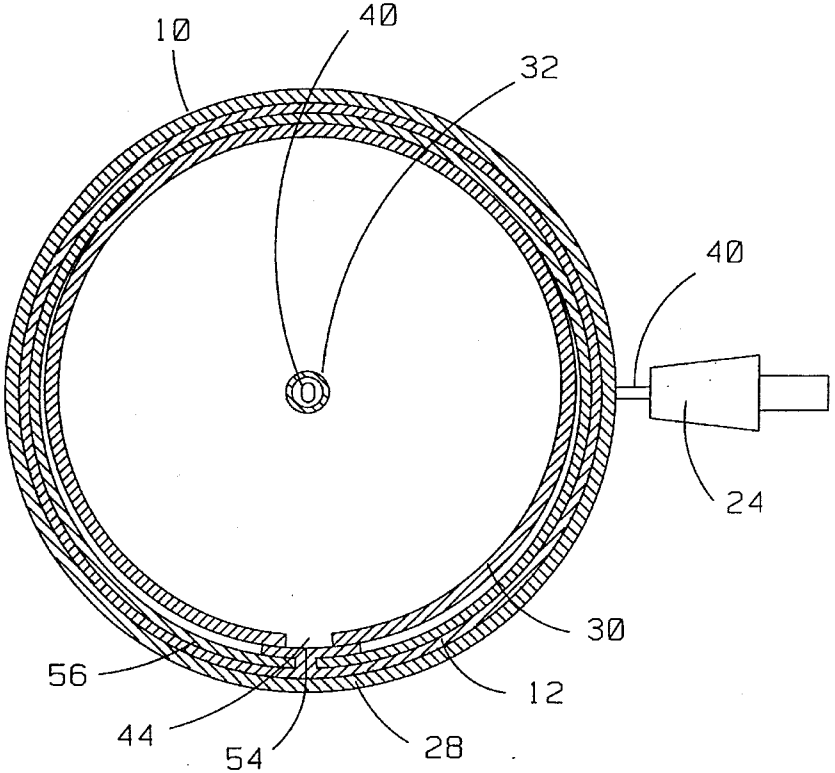
FIG. 6 is a cross section view taken along line 6—6 of FIG. 5.

FIG. 6 shows gap 44 in greater detail, as well as the close proximity or abutment of backing material 56 with decorative material 12 and exterior transparent sleeve 28. A smooth seam 54 has been created because the edges of backing material 56 are in close proximity. The outward tension of interior sleeve 30 causes decorative materials 12 to bear upon the interior of transparent exterior sleeve 28.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. In a lamp device including a lamp base, a light socket connected to the lamp base, and an electric cord electrically connected to the light socket, the improvement comprising:

the lamp base having an exterior transparent sleeve formed of rigid or semi-rigid materials;

one or more decorative articles, and an interior sleeve or sheet formed of semi-rigid flexible material, the interior sleeve having securing means for producing and exerting outward tension for bearing against and securing said one or more decorative articles in confronting engagement with an interior surface of the exterior transparent sleeve; and means for securing the light socket external to the lamp base with the light socket being disposed outwardly away from the lamp base in a vertically spaced apart relationship from the lamp base;

wherein the one or more decorative articles to be displayed by said lamp base is secured within the lamp base for display purposes with the securing means of the interior sleeve or sheet.

2. The device according to claim 1 wherein the interior sleeve or sheet is preformed and adapted to fit the exterior transparent sleeve.

3. The device according to claim 1 in which the interior sleeve or sheet is composed of a polymeric material, a metal or a resin impregnated paper.

4. The device according to claim 1 in which the exterior transparent sleeve is composed of glass, acrylic or another polymeric substance.

5. The device according to claim 1 in which the lamp, base further has;

a cap and a foot, each of which abut and secure the exterior transparent sleeve and the interior sleeve or sheet to the lamp base.

6. The device according to claim 1 in which the lamp base further has;

backing material to which the one or more decorative articles are secured.

7. The device according to claim 6 in which the backing material is comprised of paper, cardboard or other fibrous materials.

8. The device according to claim 1 in which the exterior transparent sleeve is cylindrical in configuration.

9. A lamp device comprising:

(a) a lamp base having an exterior transparent sleeve having a top end, a decorative material, and an interior sleeve formed of semi-rigid flexible material, the interior sleeve having securing means for producing and exerting outward tension for bearing against and securing the decorative material in confronting engagement with an interior surface of the exterior transparent sleeve;

(b) a light socket;

(c) means for connecting the light socket external to the lamp base with the light socket being disposed outwardly away from the lamp base in a vertically spaced apart relationship from a top end of the exterior transparent sleeve; and (d) an electric cord electrically connected to the light socket.

10. The device according to claim 9, further comprising a harp socket connected to the light socket and a harp connected to the harp socket.

11. The device according to claim 9, wherein the interior sleeve has a first side edge in a spaced apart relationship from a second side edge, the first and second side edges defining a longitudinal gap therebetween for expansion and contraction of the interior sleeve.

12. The device according to claim 9, further comprising backing material secured to the decorative material.

13. The device according to claim 9, wherein the interior sleeve has first and second side edges movable relative to one another.

14. A lamp device comprising:

(a) a lamp base having an exterior transparent sleeve having a top end and a bottom end, a decorative material, an interior sleeve formed of semi-rigid flexible material, the interior sleeve having securing means for producing and exerting outward tension for bearing against and securing the decorative material in confronting engagement with an interior surface of the exterior transparent sleeve, a cap in confronting engagement with the top end of the exterior transparent sleeve, the cap having an aperture extending therethrough, and a foot in confronting engagement with the bottom end of the exterior transparent sleeve;

(b) a light socket;

(c) means for connecting the light socket external to the lamp base with the light socket being disposed outwardly away from the cap in a vertically spaced apart relationship from the cap; and (d) an electric cord electrically connected to the light socket and extending through the aperture in the cap.

15. The device according to claim 14, wherein the means for connecting a light socket to the lamp device includes a lamp pipe having a first pipe end and a second pipe end, the first pipe end extending through the aperture in the cap with the light socket mounted thereto, and the second pipe end being removably secured to the foot.

16. The device according to claim 15, further comprising a harp socket connected to the light socket and a harp connected to the harp socket.

17. The device according to claim 15, wherein the interior sleeve has a first side edge in a spaced apart relationship from a second side edge, the first and second side edges defining a longitudinal gap therebetween for expansion and contraction of the interior sleeve.

18. The device according to claim 17, further comprising backing material secured to the decorative material.

19. The device according to claim 14, wherein the interior sleeve has first and second side edges movable relative to one another.

* * * * *